US005244516A

United States Patent [19]

Kawaguchi

[11] Patent Number: 5,244,516

[45] Date of Patent: Sep. 14, 1993

[54] ALUMINUM ALLOY PLATE FOR DISCS WITH IMPROVED PLATABILITY AND PROCESS FOR PRODUCING THE SAME

[75] Inventor: Masahiro Kawaguchi, Moka, Japan

[73] Assignee: Kabushiki Kaisha Kobe Seiko Sho, Kobe, Japan

[21] Appl. No.: 927,740

[22] Filed: Aug. 12, 1992

Related U.S. Application Data

[63] Continuation of Ser. No. 774,151, Oct. 15, 1991, abandoned, which is a continuation of Ser. No. 418,199, Oct. 6, 1989, abandoned.

[30] Foreign Application Priority Data

Oct. 18, 1988 [JP] Japan ..... 63-262650

[51] Int. Cl.[5] ..... C22F 1/04

[52] U.S. Cl. ..... 148/551; 148/552; 148/691; 148/439

[58] Field of Search ..... 148/551, 552, 691, 439

[56] References Cited

FOREIGN PATENT DOCUMENTS

| | | |
|---|---|---|
| 56-98461 | 8/1981 | Japan . |
| 61-179843 | 8/1986 | Japan . |
| 61-266548 | 11/1986 | Japan . |
| 62-54043 | 3/1987 | Japan . |
| 63-111153 | 5/1988 | Japan . |
| 1-225739 | 9/1989 | Japan . |
| 1-298134 | 12/1989 | Japan . |

OTHER PUBLICATIONS

*A Dictionary of Metallurgy*, A. D. Merriman, MacDonald & Evans, Ltd., London: 1958, pp. 126 and 327.

Photocopy of co-pending U.S. application Ser. No. 07/511,944; Apr. 16, 1990, Applicants are E. Usui and M. Kawaguchi.

*Primary Examiner*—R. Dean

*Assistant Examiner*—Robert R. Koehler

*Attorney, Agent, or Firm*—Oblon, Spivak, McClelland, Maier & Neustadt

[57] ABSTRACT

Disclosed herein is an aluminum alloy plate for discs superior in Ni-P platability and adhesionability of plated layer and having a high surface smoothness with a minimum of nodules and micropits, said aluminum alloy plate comprising an aluminum alloy containing as essential elements Mg in an amount more than 3% and equal to or less than 6%, Cu in an amount equal to or more than 0.03% and less than 0.3%, and Zn in an amount equal to or more than 0.03% and equal to or less than 0.4%, and as impurities Fe in an amount equal to or less than 0.07% and Si in an amount equal to or less than 0.06% in the case of semi-continuous casting, or Fe in an amount equal to or less than 0.1% and Si in an amount equal to or less than 0.1% in the case of strip casting, and also containing Al-Fe phase intermetallic compounds, with the maximum size being smaller than 10 μm and the number of particles larger than 5 μm being less than 5 per 0.2 $mm^2$, and Mg-Si phase intermetallic compounds, with the maximum size being smaller than 8 μm and the number of particles larger than 5 μm being less than 5 per 0.2 $mm^2$.

11 Claims, No Drawings

ALUMINUM ALLOY PLATE FOR DISCS WITH IMPROVED PLATABILITY AND PROCESS FOR PRODUCING THE SAME

This is a continuation of application Ser. No. 07/774,151, filed Oct. 15, 1991, now abandoned, which is a continuation of application Ser. No. 07/418,199, filed Oct. 6, 1989, now abandoned.

BACKGROUND OF THE INVENTION

1. Field of the Invention

The present invention relates to an aluminum alloy plate for discs with improved platability and also to a process for producing the same. More particularly, it is concerned with an aluminum alloy plate for discs such as magnetic discs used as the recording media of computers and also with a process for their production. This alloy plate has, also, its outstanding properties at the time of surface preparation and plating, and provides a smoothly finished surface having a minimum of nodules and micropits after polishing.

2. Description of the Prior Art

An aluminum alloy has been the sole material for producing the substrate of magnetic discs used as the recording media of computers because it meets most requirements for the substrate lightness, non-magnetism, rigidity to permit high-speed revolution, excellent surface finish obtained by precision cutting or polishing, and a certain degree of corrosion resistance.

According to the conventional technology, the magnetic recording discs are provided with a magnetic film mainly by the coating method. However, this method is being replaced by the plating method or sputtering method which has recently been developed to perform high-density recording on magnetic discs. The substrate for magnetic discs designed for plating or sputtering undergoes plating with Ni-P. This substrate is made of AA5086 alloy (Al-Mg) in most cases; but it is also made of JIS 7075 alloy (Al-Zn-Mg) in some cases.

These conventional aluminum alloys have a disadvantage in that the substrates which have undergone Ni-P plating tend to have rough surfaces, because they contain many intermetallic compounds (such as Al-Fe, Al-Fe-Si, Al-Fe-Mn, and Mg-Si) which are larger than 10 μm. These compounds are pulled off during cutting, polishing, and surface preparation for Ni-P plating, leaving small holes in the substrate surface.

The JIS 7057 alloy (Al-Zn-Mg) has an additional disadvantage attributable to its excessive content of Cu and Zn. These elements form a coarse intermetallic compound which is responsible for the surface roughness after Ni-P plating. Moreover, if the cooling rate during flat-baking is improper, internal stress is induced. This stress worsens the flatness of the aluminum plate.

As mentioned above, the conventional aluminum alloys for magnetic discs have a disadvantage in that the resulting discs tend to have rough surface and hence plating defects such as pits (small holes). It has been a common practice to eliminate this disadvantage by forming a comparatively thick plated layer (30–50 μm). However, a thick plated layer is expensive. Thus, reducing the thickness of the plated coating is important for cost reduction and improved productivity.

Apart from reducing the thickness of the plated coating, it is also important to reduce pits and roughness in the pretreatment for plating. To this end, an attempt was made to reduce the size of intermetallic compounds by using highly pure raw material such as 99.9% or 99.99% purity aluminum. Unfortunately, it was found that an aluminum alloy made of high-purity raw aluminum makes plated the surface rougher and lowers the adhesion of plated the at layer.

The present inventors found that this is due to the following reason. When an aluminum alloy substrate undergoes zincate treatment as the pre-finishing for plating, the deposition of zinc is coarse and uneven because the high-purity raw aluminum contains a lesser amount of Fe. In order to address the above-mentioned problems and to meet many requirements for magnetic discs, the present inventors carried out an extensive study which led to the finding that the platability can be improved by adding Cu and Zn as the alloying elements. On the basis of this finding, the present inventors previously proposed an aluminum alloy for magnetic discs. (See Japanese Patent Publication No. 2018/1987.) This aluminum alloy has been put to practical use with good reputation.

There is an increasing demand for low cost magnetic discs, and this makes it more important than ever to reduce the thickness of Ni-P plating and to reduce the expense for polishing. In other words, it is important to obtain a smooth plating surface by reducing nodules (semispherical projections which occur on the disc surface during Ni-P plating) and also by reducing micropits (very small holes in the surface layer which have been ignored in the past).

SUMMARY OF THE INVENTION

It is an object of the present invention to provide an aluminum alloy plate for discs which meet the above-mentioned requirements for magnetic discs and optical discs. Another object is to provide an aluminum material for discs with a smooth plating surface which has a minimum of plating defects (such as micropits and nodules) and permits easy surface preparation and good plating adhesion.

It is another object of the present invention to provide a process for producing the aluminum alloy plate for discs at a low cost.

The present inventors have carried out a series of experiments which have led to the finding that the occurrence of nodules and micropits on the plating surface is closely related with inhomogeneitie of the substrate surface after the pretreatment for plating. These findings indicate that it is necessary to reduce the coarse intermetallic compounds which are responsible for the inhomogeneities. It has been found that this object is achieved only by discriminating between Al-Fe phase intermetallic compounds and Mg-S phase intermetallic compounds. These two intermetallic compounds have been considered to have the same effects on Ni-P plating in the past. Therefore, besides controlling the chemical composition of aluminum alloy, it is necessary to specify the size and quantity of these intermetallic compounds. The present invention has been made possible by these findings.

Accordingly, the gist of the present invention resides in an aluminum alloy plate for discs which is superior in Ni-P platability and plating adhesion and has a high surface smoothness with a minimum of nodules and micropits, said aluminum alloy plate comprising an aluminum alloy containing as essential elements Mg in an amount more than 3% and equal to or less than 6%, Cu in an amount equal to or more than 0.03% and less than 0.3%, and Zn in an amount equal to or more than 0.03% and equal to or less than 0.4%, and as impurities Fe in an amount equal to or less than 0.07% and Si in an amount equal to or less than 0.06% in the case of semi-continuous casting, or Fe in an amount equal to or less than 0.1% and Si in an amount equal to or less than 0.1% in the case of strip casting, and also containing Al-Fe phase intermetallic compounds, with the maximum size being smaller than 10 μm and the number of particles larger than 5 μm being less than 5 per 0.2 $mm^2$, and Mg-Si intermetallic compounds, with the maximum size being smaller than 8 μm and the number of particles larger than 5 μm being less than 5 per 0.2 $mm^2$.

The aluminum alloy plate of the present invention is produced by a process which comprises casting an aluminum alloy at 710° C. or above, thereby giving an ingot, subjecting the ingot to soaking at 450° C. or above, and subjecting the soaked ingot to hot rolling at a rolling start temperature of 500° C. or above and subsequently cold rolling, said aluminum alloy containing as essential elements Mg in an amount more than 3% and equal to or less than 6%, Cu in an amount equal to or more than 0.03% and less than 0.3%, and Zn in an amount equal to or more than 0.03% and equal to or less than 0.4%, and as impurities Fe in an amount equal to or less than 0.07% and Si in an amount equal to or less than 0.06%.

The aluminum alloy plate of the present invention is produced by a process which comprises casting an aluminum alloy at 690° C. or above, thereby giving a coil of strip cast sheet thicker than 3 mm, and subjecting the sheet to cold rolling, said aluminum alloy containing as essential elements Mg in an amount more than 3% and equal to or less than 6%, Cu in an amount equal to or more than 0.03% and less than 0.3%, and Zn in an amount equal to or more than 0.03% and equal to or less than 0.4%, and as impurities Fe amount equal to or less than 0.1%.

DETAILED DESCRIPTION OF THE INVENTION

The invention will be explained in more detail in the following.

The aluminum alloy plate of the present invention is made of an aluminum alloy having a specific composition which was established for the reasons mentioned below.

Mg: This element is necessary to impart mechanical strength to the aluminum alloy plate to be used as a disc substrate. With a content less than 3%, Mg does not produce the desired effect; and with a content in excess of 6%, Mg is liable to cause edge cracking during rolling (resulting in low productivity) and is also likely to form non-metal impurities such as MgO owing to the oxidation at high temperatures which takes place during melting and casting. Therefore, the preferred content of Mg is in the range of $3\% < Mg \leqq 6\%$.

Cu and Zn: These elements cause the substrate to be etched uniformly during the pretreatment for plating. They also permit zinc to separate in the form of a uniform fine deposit on the substrate surface, during zincate treatment. All these effects reduce the roughness of the Ni-P plated coating and improve the adhesion of the plated layer to the substrate. With a content of Cu and Zn less than 0.03% each, they do not produce the above-mentioned effects. With a content of Cu in excess of 0.3%, or with a content of Zn in excess of 0.4%, many nodules are formed on the plated surface and excessive etching of the grain boundary occurs upon pretreatment, which impairs the smoothness of the plated surface. Therefore, the content of Cu should be in the range of $0.03\% \leqq Cu < 0.3\%$, preferably $0.05\% \leqq Cu \leqq 0.2\%$, and the content of Zn should be in the range of $0.03\% \leqq Zn < 0.4\%$, preferably $0.06\% \leqq Zn \leqq 0.3\%$. Meanwhile, it is essential to add Cu and Zn in combination; if they are added individually even in an amount within the above-specified range, a great difference occurs in chemical reactivity between grains, which causes surface roughness due to the difference of crystalized grains in level.

Size and number of Al-Fe phase intermetallic compounds and of Mg-Si phase intermetallic compounds: Al-Fe phase intermetallic compounds (such as Al-Fe, Al-Fe-Si, and Al-Fe-Mn) and Mg-Si phase intermetallic compounds result from Fe and Si as impurities in the raw aluminum. They form projections or pockets during the machining (such as cutting, grinding, and polishing) of the disc substrate, and they also drop off or dissolve (forming micropits in the plated layer) during the pretreatment for Ni-P plating.

If Al-Fe phase intermetallic compounds are present in the form of particles greater than 10 μm, or if Mg-Si phase intermetallic compounds are present in the form of particles greater than 8 μm, they cause micropits in the plated layer even in the case where the pretreatment for plating is carried out under mild etching conditions, with the etching amount being 10 $mg/dm^2$.

In addition, even though Al-Fe phase intermetallic compounds are present in the form of particles smaller than 10 μm, or even though Mg-Si phase intermetallic compounds are present in the form of particles smaller than 8 μm, they have an adverse effect just as the coarse intermetallic compounds do, if the two types of intermetallic compounds which are larger than 5 μm are present in a quantity greater than 5 pieces per 0.2 $mm^2$. Therefore, it is necessary that Al-Fe phase intermetallic compounds should have a maximum size smaller than 10 μm and the number of particles larger than 5 μm should be less than 5 per 0.2 $mm^2$. The Mg-Si phase intermetallic compounds should have a maximum size smaller than 8 μm and the number of the particles larger than 5 μm should be less than 5 per 0.2 $mm^2$.

If the size of the Al-Fe intermetallic compounds is greater than 6 μm, or if the size of the Mg-Si phase intermetallic compounds is greater than 5 μm, they cause micropits in the plated layer even in the case where the pretreatment for plating is carried out under mild etching conditions, with the etching amount being 11 to 20 $mg/dm^2$.

In addition, even though Al-Fe intermetallic compounds are present in the form of particles smaller than 6 μm, or even though Mg-Si intermetallic compounds are present in the form of particles smaller than 5 μm, they have an adverse effect just as the coarse intermetallic compounds do, if the former intermetallic compounds which are larger than 5 μm are present in a quantity greater than 5 pieces per 0.2 $mm^2$ and the latter intermetallic compounds larger than 4 μm are present in a quantity greater than 5 pieces per 0.2 mm. Therefore, it is necessary that Al-Fe phase intermetallic compounds should have a maximum size smaller than 6 μm and that the number of particles larger than 5 μm should be less than 5 per 0.2 $mm^2$. The Mg-Si phase intermetallic compounds should have a maximum size smaller than 5 μm and the number of the particles larger than 4 μm should be less than 5 per 0.2 $mm^2$.

The number and size of the intermetallic compounds (those composed mainly of Al-Fe and those composed mainly of Mg-Si) are greatly affected by the content of Fe and Si in the raw material; and they also vary depending on the casting conditions and soaking conditions.

They are reduced when the casting temperature is raised or the cooling rate during the casting stage is increased (in case of strip casting the cooling rate is raised by reducing the casting thickness). It follows, therefore, that the content of impurities (Fe and Si) in the aluminum alloy in the present invention is not determined unconditionally. However, in the case of semi-continuous casting, the content of Fe should be equal to or less than 0.07%, preferably 0.04%, and the content of Si should be equal to or less than 0.06%, preferably 0.04%. In the case of strip casting, the content of Fe should be equal to or less than 0.1%, preferably 0.07%, and the content of Si should be equal to or less than 0.1%, preferably 0.06%. The lower limit of the content of Fe and Si is not specifically established; but the content of Fe should preferably be as low as 0.003% and the content of Si should preferably be as low as 0.005% from an economic point of view, because intermetallic compounds whose size is smaller than 2 μm do not cause plating defects unless the plated layer is extremely thin (say, less than 3 μm). The content of Si can be reduced by adjusting the soaking conditions, as mentioned later.

The aluminum alloy plate for discs pertaining to the present invention may contain Mn, Cr, Ti, etc., in addition to the above-mentioned impurities, in an amount permissible in JIS 5086 alloy, because they reduce the size of recrystallized particles, prevent the particle growth during the heat treatment at a high temperature, and form a fine cast structure. However, the content of Mn, Cr, and Ti should be 0.4% or less, 0.1% or less, and 0.1% or less, respectively, because the excessive addition of these elements forms coarse intermetallic compounds and causes inclusion. Moreover, the B and Be content, which are usually added during the melting stage, should preferably be less than 100 ppm.

The following is a process for producing the aluminum alloy plate for discs pertaining to the present invention. The alloy plate is produced by casting from an aluminum alloy having the above-mentioned composition. The casting may be either ordinary semi-continuous casting for a 300–600 mm thick ingot or strip casting for an ingot thinner than 30 mm. However, strip casting is desirable because it permits the reduction of the size and number of the above-mentioned intermetallic compounds even in the case where the raw aluminum is a low-purity one. Meanwhile, in the case of strip casting, the coiled sheet should be thicker than 3 mm because it undergoes cold rolling with a reduction greater than 50% so that the disc substrate has a desired accuracy after punching, cutting, and polishing.

Regardless of which casting method is employed, the casting temperature should be high so as to reduce intermetallic compounds. It should preferably be higher than 710° C. in the case of ordinary semi-continuous casting.

Subsequently, the aluminum alloy ingot (or strip cast sheet) undergoes soaking and rolling in the usual way. In the case of semi-continuous casting, soaking should be carried out at 450° C. or above, preferably 500° C. or above for 1 hour or longer, so as to reduce Mg-Si phase intermetallic compound.

Large ingot should undergo hot rolling and cold rolling from the standpoint of productivity, and hot rolling should preferably be carried out at 500° C. or above so as to reduce Mg-Si phase intermetallic compound. In the case of strip casting, the coil may undergo cold rolling alone (with the hot rolling omitted). However, a comparatively thick strip may undergo, following casting, hot rolling under the above-mentioned conditions. In either case, the cold rolling should preferably be followed by annealing (at 300°–450° C. for 2–5 hours) according to need. Annealing before or in the course of rolling is effective in removing segregation and improving rollability.

The rolled sheet is punched or cut into a disc form, followed by flat-baking. This heat treatment may be carried out, with the disc surface under a load, so as to improve flatness.

The rolled sheet usually has surface roughness (Ra) of 0.1 to 0.5 μm, which is too large for the disc substrate. In addition, it has a great strain to be reduced. For this reason, the disc surface is removed by cutting or polishing. The removal from the surface of less than 10 μm thick is not sufficient for obtaining excellent flatness; and the removal from the surface of more than 500 μm thick will provide the satisfactory disk performance but is economically wasteful. Therefore, the thickness of the surface to be removed from the disc substrate should be 10 to 500 μm. After this step, the disc substrate may undergo annealing for obtaining more excellent flatness, according to need.

Subsequently, the disc substrate undergoes pretreatment such as degreasing, acid cleaning, and zincate treatment, and then a non-magnetic plated layer (such as Ni-P) is formed on the pretreated disc substrate.

Etching in the pretreatment may be mild etching (with the amount of etching being 3–10 mg/dm$^2$) or hard etching (with the amount of etching being 11 mg/dm$^2$ or more). The latter is advantageous in that a high surface smoothness with a minimum of pits can be obtained even though the polishing allowance is reduced. Etching should preferably be carried out by acid cleaning. It is in this respect that the aluminum alloy plate of this invention is superior to the conventional one which can undergo only weak etching.

The thickness of the plated layer should be thicker than 3 μm. With a thickness less than 3 μm, the plated layer does not conceal micropits completely, nor does it decrease the surface roughness. In addition, such a thin plated layer has too small a polishing allowance to give a smooth uniform finish. The thickness of the plated layer should be thicker than 5 μm from the view point of the surface hardness of the disc substrate. The upper limit of the thickness is 30 μm from the economical point of view, although a thick plated layer has no adverse effect on performance.

The thus plated disc is polished and finally provided with a magnetic layer by plating or sputtering to give a magnetic disk. The allowance for finish polishing can be reduced; it should preferably be 0.2 to 2 μm. Polishing provides a highly smooth surface with a minimum of micropits.

EXAMPLES

The invention will be described in more detail with reference to the following examples.

Aluminum alloys Nos. 1 to 7 (Working Examples) and Nos. 8 to 13 (Comparative Examples) were prepared according to the compositions as shown in Table 1. Each alloy was melted, filtered, and cast into a slab whose size is 400 mm thick, 1000 mm wide, and 3500 mm long by semicontinuous casting. After scalping, the slab underwent soaking under the conditions shown in Table 1 and then underwent hot rolling and cold rolling until the thickness was reduced to 2 mm. In the case of strip casting, the alloy was cast into a sheet measuring 6 mm thick and 800 mm wide (and an undefined length). The coil underwent annealing at 400° C. for 5 hours and then underwent cold rolling to reduce the thickness to 2 mm.

The rolled sheet underwent punching, followed by flat-baking. Thus there was obtained a ring-shaped disc having an outside diameter of 130 mm and an inside diameter of 40 mm.

The surface (60 μm thick) of the disc was removed by cutting to give a disc substrate with a surface roughness ($R_{max}$) of 0.1 μm and a thickness of 1.88 mm. The substrate was treated under the conditions specified below, and the treated substrate was examined for platability, adhesionability of plated layer, and number of nodules at asplated surface. In addition, the plated surface was polished and examined for micropits. The results are shown in Tables 1 to 3.

Treating conditions

Degreasing (dipping in U-Cleaner UA-68* 5%, at 50° C., for 5 minutes)→acid cleaning (AD-101* 10%)→zincate treatment (immersion in AD-301*, at R.T., for 1 minute)→nitric acid immersion (immersion in 50% nitric acid, at R.T., for 30 seconds)→zincate treatment (immersion in AD-301*, at R.T., for 30 seconds)→Ni-P plating (immersion in Nimuden HDX* at 90° C., plating thickness 10 μm). (* products of Uemura Kogyo Co., Ltd.) Acid cleaning for mild etching was carried out by immersion at 65° C. for 3 minutes (with the removal amount of etching being 8 mg/dm$^2$), and acid cleaning for hard etching was carried out by immersion at 75° C. for 5 minutes (with the removal amount of etching being 23 mg/dm$^2$).

The size and quantity of intermetallic compounds were measured by observing the surface (10 mm$^2$) of the disc substrate under a scanning electron microscope with a magnification of ×1000.

The platability was ranked in three grades (A, B, and C) according to the surface state observed after the second zincate treatment.

A: fine and uniform deposition

B: intermediate deposition, and severely etched particle boundary

C: coarse and uneven deposition

The adhesion of the plating layer was evaluated by checking to see if plating peels off when the disc substrate is bent 90°. Specimens free of peeling are indicated by A and specimens with peeling (even though partial) are indicated by B.

The surface roughness (in terms of nodules) was evaluated by measuring the roughness of the plated surface using a roughness meter. (Measurements were carried out for a total length of 80 mm at randomly selected 20 spots, and the number of projections greater than 0.2 μm was counted.) Specimens having 0 to 2 projections are indicated by A, specimens having 3 to 10 projections are indicated by B, and specimens having 11 or more projections are indicated by C.

The surface smoothness was evaluated by observing the plated surface which had been polished with alumina powder. The observation was made at 100 spots using a microscope with a magnification of ×640. Specimens having no pits larger than 2 μm in diameter are indicated by A, specimens having 1 to 4 pits are indicated by B, and specimens having 5 or more pits or having 1 or more pits larger than 8 μm in diameter are indicated by C. Meanwhile, the removal amount by polishing was 0.5 μm or 1.5 μm.

It is noted from Table 1 that the disc substrate pertaining to the present invention contains Al-Fe phase intermetallic compounds whose size is smaller than 10 μm, with the number of particles larger than 5 μm being less than 5 pieces per 0.2 mm$^2$, and also contains Mg-Si phase intermetallic compounds whose size is smaller than 8 μm, with the number of particles larger than 5 μm being less than 5 pieces per 0.2 mm$^2$.

Some specimens in Comparative Examples (in which the composition is out of the scope of the present invention) have the same intermetallic compound size and quantity as specimens in Working Examples; however, as noted in Table 2 and 3, they are poor in Ni-P platability and plating adhesion, or they have many nodules and micropits even though they are good in platability and plating adhesion.

It is noted that specimens in Working Examples are by far superior to those in Comparative Examples in view of the fact that the former specimens are good at platability and plating adhesion and have a very few nodules and micropits. It is particularly noted that specimens in Working Examples have a very few nodules even in the case where they undergo hard etching and also have a high surface precision, with a minimum of micropits, even in the case where the polishing allowance is small (say, 0.5 μm).

TABLE 1

| No. | Chemical Composition (wt %) Si | Fe | Cu | Mn | Mg | Cr | Zn | Ti | Casting method (casting temp. °C.) |
|---|---|---|---|---|---|---|---|---|---|
| 1 | 0.005 | 0.005 | 0.05 | 0.005 | 4.1 | 0.06 | 0.15 | 0.001 | semi-continuous (720) |
| 2 | 0.01 | 0.02 | 0.03 | 0.03 | 4.0 | 0.07 | 0.09 | 0.001 | semi-continuous (715) |
| 3 | 0.02 | 0.02 | 0.07 | 0.03 | 5.2 | 0.06 | 0.18 | 0.001 | semi-continuous (725) |
| 4 | 0.04 | 0.05 | 0.06 | 0.03 | 4.0 | 0.07 | 0.09 | 0.001 | semi-continuous (725) |
| 5 | 0.008 | 0.007 | 0.07 | 0.02 | 3.9 | 0.06 | 0.22 | 0.001 | strip (700) |
| 6 | 0.03 | 0.04 | 0.16 | 0.23 | 4.2 | 0.06 | 0.27 | 0.001 | strip (715) |
| 7 | 0.04 | 0.05 | 0.09 | 0.03 | 3.8 | 0.07 | 0.14 | 0.001 | strip (710) |
| 8 | 0.005 | 0.005 | 0.001 | 0.002 | 4.5 | 0.001 | 0.001 | 0.001 | semi-continuous (715) |
| 9 | 0.07 | 0.09 | 0.15 | 0.03 | 4.2 | 0.09 | 0.15 | 0.001 | semi-continuous (720) |
| 10 | 0.02 | 0.02 | 0.94 | 0.03 | 4.3 | 0.06 | 0.15 | 0.001 | semi-continuous (700) |
| 11 | 0.02 | 0.02 | 0.16 | 0.02 | 4.0 | 0.06 | 1.67 | 0.001 | semi-continuous (700) |
| 12 | 0.03 | 0.04 | 0.002 | 0.03 | 4.1 | 0.06 | 0.002 | 0.001 | semi-continuous (715) |
| 13 | 0.02 | 0.03 | 0.001 | 0.02 | 3.9 | 0.06 | 0.001 | 0.001 | strip (700) |

| | Max. intermetallic compound | no. of Al—Fe | no. of Mg—Si |
|---|---|---|---|

TABLE 1-continued

| No. | Hot rolling start temp. (°C.) | Annealing temp. (°C.) | diameter Al—Fe (μm) | diameter Mg—Si (μm) | phase compound larger than 5 μm per 0.2 mm² | phase compound larger than 5 μm per 0.2 mm² |
|---|---|---|---|---|---|---|
| 1 | 500 | — | 3 | 2 | 0 | 0 |
| 2 | 510 | — | 8 | 6 | 3.4 | 1.9 |
| 3 | 510 | — | 9 | 7 | 3.6 | 2.7 |
| 4 | 510 | — | 10 | 8 | 4.8 | 4.4 |
| 5 | — | 400° C. × 5 h | 1 | 1 | 0 | 0 |
| 6 | — | " | 4 | 3 | 0 | 0 |
| 7 | — | " | 5 | 2 | 0 | 0 |
| 8 | 480 | — | 3 | 2 | 0 | 0 |
| 9 | 510 | — | 12 | 9 | 9.6 | 4.3 |
| 10 | 470 | — | 9 | 8 | 3.7 | 2.9 |
| 11 | 470 | — | 9 | 7 | 3.8 | 2.8 |
| 12 | 460 | — | 10 | 8 | 4.1 | 3.1 |
| 13 | — | 400° C. × 5 h | 3 | 2 | 0 | 0 |

Nos. 8 to 13 denote Comparative Examples.

TABLE 2

(Conditions of acid cleaning: hard etching = 75° C. × 5 min)

| Alloy No. | Platability | Adhesion-ability of plated layer | Nodule | Surface uniformity after polishing 0.5 μm polishing | Surface uniformity after polishing 1.5 μm polishing |
|---|---|---|---|---|---|
| 1 | A | A | A | A | A |
| 2 | A | A | A | A | A |
| 3 | A | A | A | A | A |
| 4 | A | A | A | B | A |
| 5 | A | A | A | A | A |
| 6 | A | A | A | A | A |
| 7 | A | A | A | A | A |
| 8 | C | C | B | C | B |
| 9 | A | A | A | C | C |
| 10 | A | A | B | C | B |
| 11 | A | A | B | C | B |
| 12 | B | C | A | B | A |
| 13 | C | C | A | C | B |

Nos. 8 to 13 denote Comparative Examples.

TABLE 3

(Conditions of acid cleaning: mild etching = 65° C. × 3 min)

| Alloy No. | Platability | Adhesion-ability of plated layer | Nodule | Surface uniformity after polishing 0.5 μm polishing | Surface uniformity after polishing 1.5 μm polishing |
|---|---|---|---|---|---|
| 1 | A | A | A | A | A |
| 2 | A | A | A | A | A |
| 3 | A | A | A | A | A |
| 4 | A | A | A | B | A |
| 5 | A | A | A | A | A |
| 6 | A | A | A | A | A |
| 7 | A | A | A | A | A |
| 8 | C | C | C | C | B |
| 9 | A | A | B | C | C |
| 10 | A | A | C | B | A |
| 11 | A | A | C | B | A |
| 12 | B | C | A | B | A |
| 13 | C | C | B | C | B |

Nos. 8 to 13 denote Comparative Examples.

As mentioned above, according to the present invention, the aluminum alloy plate for discs contain, as essential elements, Mg, Cu, and Zn in specific amounts and also contain, as impurities, Fe and Si in specific amounts so that the constituent elements form Al-Fe phase intermetallic compounds whose size and quantity are within a certain range and also form Mg-Si phase intermetallic compounds whose size and quantity are within a certain range. The aluminum alloy plate for discs provides a smooth plated surface which has superior platability and plating adhesion, and also is free of plating defects such as micropits and nodules. The aluminum alloy plate permits surface preparation by hard etching and also permits the reduction of the plating thickness and the polishing allowance for plated surface. Therefore, the present invention contributes to the cost reduction of magnetic discs. The aluminum alloy plate is suitable as a raw material for magnetic discs and optical discs.

What is claimed is:

1. A process for producing an aluminum alloy plate for discs superior in Ni-P platability and adhesionability of plated layer and having a high surface smoothness with a minimum of modules and micropits, said process comprising casting an aluminum alloy at 710° C. or above, thereby giving an ingot, subjecting the ingot to soaking at 450° C. or above, and subjecting the soaked ingot to hot rolling at a rolling start temperature of 500° C. or above and subsequently cold rolling, and recovering an aluminum alloy consisting essentially of Mg in an amount more than 3% and equal to or less than 6%, Cu in an amount equal to or more than 0.03% and less than 0.3%, and Zn in an amount equal to or more than 0.03% and equal to or less than 0.4%, the balance Al and as impurities Fe in an amount equal to or less than 0.07%, Si in an amount equal to or less than 0.06%, intermetallic compounds of Al-Fe phase, with the maximum size being smaller than 6 μm and the number of particles larger than 5 μbeing less than 5 per 0.2 mm², and intermetallic compounds of Mg-Si phase, with the maximum size being smaller than 5 μm and the number of particles larger than 4 μm being less than 5 per 0.2 mm².

2. A process as claimed in claim 1, wherein the soaking is carried out at 500° C. or above for 1 hour or longer.

3. A process for producing an aluminum alloy plate for discs superior in Ni-P platability and adhesionability of plated layer and having a high surface smoothness with a minimum of nodules and micropits, said process comprising casting an aluminum alloy at 690° C. or above, thereby giving a coil of strip cast sheet thicker than 3 mm, and subjecting the sheet to cold rolling, and recovering an aluminum alloy consisting essentially of Mg in an amount more than 3% and equal to or less than 6%, Cu in an amount equal to or more than 0.03% and less than 0.3%, and Zn in an amount equal to or more than 0.03% and equal to or less than 0.4%, the balance Al and as impurities Fe in an amount equal to or less than 0.1%, Si in an amount equal to or less than 0.1%, intermetallic compounds of Al-Fe phase, with the maximum size being smaller than 6 μm and the number of particles larger than 5 μm being less than 5 per 0.2 $mm^2$, and intermetallic compounds of Mg-Si phase, with the maximum size being smaller than 5 μm and the number of particles larger than 4 μm being less than 5 per 0.2 $mm^2$.

4. The process of claim 3 further comprising subjecting the cast sheet to hot rolling at a rolling start temperature of 500° or above and subsequently cold rolling.

5. An aluminum alloy plate for discs superior in Ni-P platability and adhesionability of the plated layer and having a high surface smoothness with a minimum of nodules and micropits obtained by a semi-continuous casting process comprising casting an aluminum alloy at 710° C. or above, thereby giving an ingot, subjecting the ingot to soaking at 450° C. or above, then subjecting the soaked ingot to hot rolling at a rolling start temperature of 500° C. or above and subsequently cold rolling and etching to obtain said aluminum alloy plate consisting essentially of:

3 to 6 wt. % of Mg, 0.03 to 0.3 wt. % of Cu, 0.1 to 0.4 wt. % of Zn, the balance Al and impurities; wherein as impurities Fe in an amount of 0.01–0.07 wt %, as impurities Si in an amount equal to or less than 0.06 wt %, intermetallic compounds of Al-Fe phase, with the maximum size being smaller than 6 μm and the number of particles larger than 5 μm being less than 5 per 0.2 $mm^2$, and intermetallic compounds of Mg-Si phase, with the maximum size being smaller than 5 μm and the number of particles larger than 4 μm being less than 5 per 0.2 $mm^2$.

6. The aluminum alloy plate for discs of claim 8, wherein the aluminum alloy plate has undergone mild etching, with the etching amount being 3 to 10 $mg/dm^2$, during the pretreatment for plating.

7. The aluminum alloy plate for discs of claim 5, wherein the aluminum alloy plate has undergone hard etching, with the etching amount being more than 11 $mg/dm^2$, during the pretreatment for plating.

8. An aluminum alloy plate for discs as claimed in claim 5, wherein said aluminum alloy plate is produced by the process comprising casting an aluminum alloy at 710° C. or above, thereby giving an ingot, subjecting the ingot to soaking at 500° C. or above, and subjecting the soaked ingot to hot rolling at a rolling start temperature of 500° C. or above and subsequently cold rolling.

9. An aluminum alloy plate for discs superior in N-P platability and adhesionability of the plated layer and having a high surface smoothness with a minimum of nodules and micropits obtained by a sheet continuous casting process comprising casting an aluminum alloy at 690° C. or above, thereby obtaining a coil of strip cast sheet thicker than 3 mm, then cold rolling and etching to obtain said aluminum alloy plate consisting essentially of:

3 to 6 wt. % of Mg, 0.03 to 0.3 wt. % of Cu, 0.1 to 0.4 wt. % of Zn, the balance Al and impurities; wherein as impurities Fe in an amount of 0.01–0.1 wt. %, as impurities Si in an amount equal to or less than 0.1 wt. %, intermetallic compounds of Al-Fe phase, with the maximum size being smaller than 6 μm and the number of particles larger than 5 μm being less than 5 per 0.2 $mm^2$, and intermetallic compounds of Mg-Si phase, with the maximum size being smaller than 5 μm and the number of particles larger than 4 μm being less than 5 per 0.2 $mm^2$.

10. The aluminum alloy plate for discs of claim 9, wherein the aluminum alloy plate has undergone mild etching, with the etching amount being 3 to 10 $mg/dm^2$, during the pretreatment for plating.

11. The aluminum alloy plate for discs of claim 9, wherein the aluminum alloy plate has undergone hard etching, with the etching amount being more than 11 $mg/dm^2$, during the pretreatment for plating.

* * * * *